United States Patent [19]

Wanke

[11] Patent Number: 4,643,127

[45] Date of Patent: Feb. 17, 1987

[54] COATING DEVICE FOR UNIFORM WEB COATING

[75] Inventor: Wilhelm Wanke, Heidenheim, Fed. Rep. of Germany

[73] Assignee: J. M. Voith GmbH, Fed. Rep. of Germany

[21] Appl. No.: 657,228

[22] Filed: Oct. 3, 1984

[30] Foreign Application Priority Data

Oct. 20, 1983 [DE] Fed. Rep. of Germany ..... 3338095

[51] Int. Cl.[4] ..... B05C 5/02

[52] U.S. Cl. ..... 118/413; 118/126; 118/410

[58] Field of Search ..... 118/126, 413, 410, 411

[56] References Cited

U.S. PATENT DOCUMENTS

| | | | |
|---|---|---|---|
| 3,518,964 | 7/1970 | Nagler | 118/410 X |
| 4,369,731 | 1/1983 | Damrau | 118/413 X |
| 4,452,833 | 6/1984 | Holt | 118/410 X |

FOREIGN PATENT DOCUMENTS

| | | | |
|---|---|---|---|
| 2055405 | 5/1972 | Fed. Rep. of Germany | 118/410 |

*Primary Examiner*—John P. McIntosh

*Attorney, Agent, or Firm*—Ostrolenk, Faber, Gerb & Soffen

[57] ABSTRACT

The disclosure concerns a coating device for coating a web which travels over a counter-roller. Upstream of a doctor blade for spreading the coating composition is a coating composition application chamber that includes a resilient tongue e.g. a leaf spring, which extends downstream toward the doctor blade and defines a hydrodynamic pressure slot between the tongue and the web. A pressure space for the coating composition is defined between the downstream end of the tongue and the doctor blade. The tongue is oriented to gradually narrow the height of the hydrodynamic pressure slot between the tongue and the web, and the tongue is resilient or resilently supported for this purpose. An additional retention wall helps close off the pressure space. The pressure space helps avoid air inclusions in the coating composition and creates a quiescent zone upstream of the doctor blade enabling uniform application of the coating.

17 Claims, 3 Drawing Figures

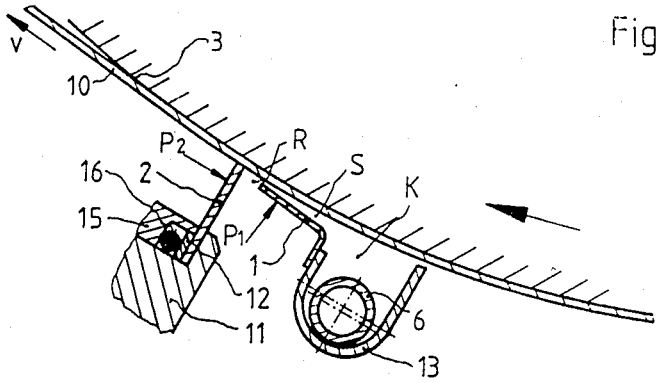
Fig. 1
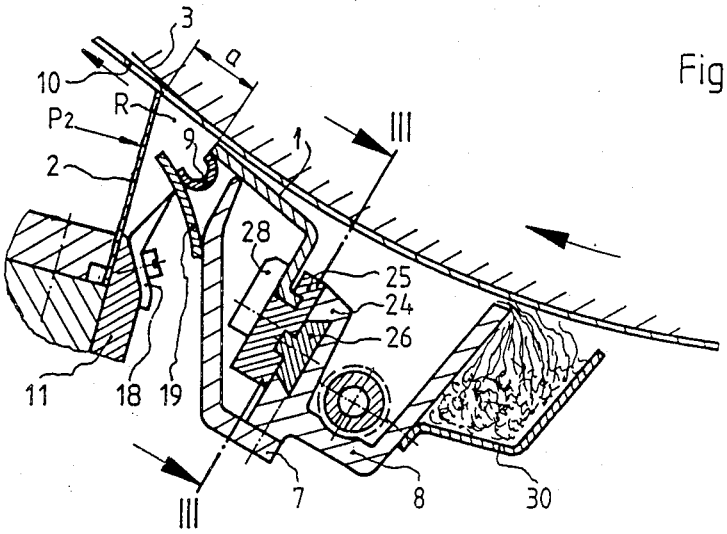
Fig. 2
Fig. 3
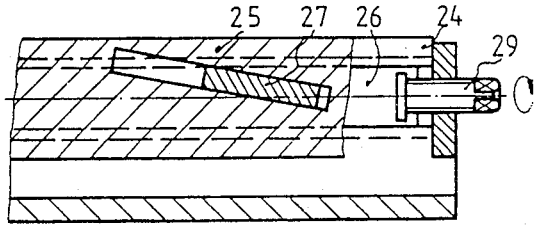

COATING DEVICE FOR UNIFORM WEB COATING

BACKGROUND OF THE INVENTION

The present invention relates to a coating device for coating a traveling web, and more particularly to a device for building up coating material pressure upstream of the doctor blade for assuring uniform coating and elimination of air inclusions.

Such a coating device is known from U.S. Pat. No. 3,418,970, which includes an applicator having an inlet-side lip and an outlet-side lip. Between them, the lips define a passage slot for coating composition. The lips are formed on a compact structural part which is connected to the application chamber in which the coating composition is supplied. The outlet-side lip is intended to run "dry" during operation, which means that none of the coating compositions is intended to emerge except for that which adheres to the web to be coated. For this purpose, very precise slots between the lips for the web of material are necessary. The application chamber is therefore supported here by hydraulic supporting elements which act against the hydrodynamic pressure which is produced between the lips and the web of material. From the lips up to the coating blade there is then a relatively long path of travel of the web of material. The advantage of this device appears to be that no lateral seals are necessary in the region of the lips. However, this device does not appear capable of preventing inclusions of air in the coating applied to the web of material.

SUMMARY OF THE INVENTION

The object of the present invention is to provide a coating device which prevents inclusion of air in the coating layer and in which an excellent bond is produced between the coating and the web of material. In addition, there should be substantial reliability in operation of the device.

The coating device of the invention operates upon a web which is moved over a rotating counter-roll. A doctor blade or coating blade extends transversely across the web and the counter-roll. The coating device of the invention is upstream of the doctor blade. It includes an application chamber which also extends across the width of the web. The coating composition is discharged into the application chamber. The height of the application chamber spaced from the web narrows along the direction of travel of the web to a relatively narrow outlet end of the chamber. This narrowing section of the application chamber defines a hydrodynamic pressure slot. That slot is defined by a tongue which is in opposition to and spaced from the web on the web outlet-side of the application chamber. The tongue is swingable, e.g. by being resiliently mounted at its upstream end or by itself being resilient over its length. The tongue may be entirely comprised of resilient material. For instance, it may be a leaf spring in its entirety, or may be a more rigid unit clamped by a leaf spring at its upstream or rear end to a fixed exterior of the application chamber. The resilient tongue is supported against the hydrodynamic pressure in the pressure slot by associated supporting means.

The distance between the outlet end of the hydrodynamic pressure slot and the doctor blade is a relatively short distance, e.g. less than 50 millimeters. This defines a short circumferential length pressure zone between the outlet from the hydrodynamic pressure slot and the coating blade or doctor blade. The pressure in that zone is somewhat elevated, as compared with the ambient pressure, as a result of the hydrodynamic pressure produced in the pressure slot and the dynamic pressure produced by the excess coating composition held back by the doctor blade. The pressure zone helps to substantially avoid inclusions of air in the coating composition and helps to form a quiescent zone upstream of the coating blade for the application of a uniform coating on the web. That pressure zone is in part defined by a retention wall spaced out from the web.

The device of the invention applies a uniform coating, as with known coating devices, while at the same time air inclusions are substantially avoided. Furthermore, to a great extent, simple mechanical parts can be used. The development of the tongue as a leaf spring provides substantially automatic adjustment of a precise slot, particularly at the outlet end of the hydrodynamic pressure slot, independently of the sagging of the counter-roll. This further improves the uniformity of the applied coating.

There is a short path of travel from the outlet end of the hydrodynamic pressure slot at the end of the tongue up to the coating or doctor blade. As a result of the functional separation of tongue and coating blade, the two can be adjusted with the optimal angular relationships. This has the following favorable effects.

(A) The tongue enables adherence of the suspension to the web and enables an optimal quantity of coating material to be applied.

(B) The coating blade enables optimal quality of the suspension applied to the surface.

(C) By the simultaneous hydraulic pressure-bond over the pressure zone, inclusions of air or flow furrows are eliminated. Thus, the runability and the quality are substantially increased.

(D) By hydraulically clear flow conditions, with only the discharge of the coating composition taking place on the coating blade, unstable zones with the risk of cavitation are avoided.

Other objects and features of the invention are described below with reference to the accompanying drawings.

BRIEF DESCRIPTION OF THE DRAWINGS

FIG. 1 is a basic side view sketch of the coating device of the invention;

FIG. 2 is a more detailed view; and

FIG. 3 is a section along the line III in FIG. 2.

DESCRIPTION OF A PREFERRED EMBODIMENT

FIG. 1 shows a coating device according to the invention. The device operates in opposition to a counter-roller 3 on which a web 10 travels. The web 10 of material travels over a counter-roll 3 with the velocity v in the direction indicated by the arrow.

The device has a feed chamber K from which the coating composition is fed to the coating blade 2 via a hydrodynamic pressure exit slot S that is defined between the web and the tongue 1 at the outlet end of the chamber K.

There is a pressure zone R between the outlet end of the hydrodynamic pressure slot S and the coating blade 2. Within the pressure zone R, the excess pressure of the coating composition emitted from the hydrodynamic pressure slot is to be at least in part maintained. This is obtained by keeping the distance from the outlet end of the hydrodynamic pressure slot S, which is formed by the tongue 1, to the coating blade or doctor blade 2 rather small. The dynamic pressure, which is produced at the coating blade 2, continues to act up to the outlet edge of the tonque 1. A coating composition retention space, which forms the pressure zone R, is formed by retention walls in order to provide support for the composition between the outlet edge of the tongue 1 and the coating blade 2. This is explained in further detail below in FIG. 2.

The liquid coating composition is fed into the pressure chamber K via feed pipe 6 with outlet openings in its lower region close to the wall 13 which forms the pressure chamber K. This assures a uniform flow of the coating composition to the hydrodynamic pressure slot S.

The coating blade 2 or doctor blade is clamped on a supporting beam 11. A pressure strip 12 is pressed against the coating blade 2 by a pressurized hose 16 contained in a holding strip 15 on the beam 11. This clamps the coating blade fast to the supporting beam 11. To change the tension, and thus the pressing force, of the coating blade 2, means are provided which exert forces $P_2$ in the direction indicated by the corresponding arrow to the coating blade. Furthermore, pressing means are provided for exerting forces $P_1$, corresponding to the arrow shown, on the resilient tongue 1 and thus make the hydrodynamic pressure slot S adjustable.

Excess pressures in the coating composition, which cover the optimal operating range of 0.02 to 0.03 bar, can be produced in the hydrodynamic pressure slot. The circumferential length of the hydrodynamic pressure slot S should be about 2 to 3 cm and not substantially greater than 5 cm. Similarly, the length of the pressure zone R in the direction of travel of the web of material should be kept as short as possible. Limits are, of course, established for this by the fact that the coating blade 2 must be swingable in order to adjust its angle of application. A too long travel distance for the web of material through the slot S and then from the coating application chamber K up to the coating blade 2 and the danger that, as a result of the drawing of liquid into the web of material, unequal consistencies in the coating composition will result over the width of the web of material.

An Exemplary pressure zone R is shown in FIG. 2. Pressing pieces 7 or a pressing strip 7 support the tongue 1 from the outside for forming the hydrodynamic pressure slot and then also serve to displace the tongue 1 and thus adjust the height of the hydrodynamic pressure slot S. A spring plate 19 is fastened, for instance by screws, to the pressure pieces 7. A flexible curved strip 9 extends between spring plate 19 and tongue 1. It may be comprised of rubber and be screwed or vulcanized onto the other parts, for instance by means of a fastening strip. Pressure fingers 18 are fastened to the supporting beam 11 for the coating blade 2. The fingers press against the spring plate 19. Upon a change in the angle of the supporting beam, which results in a corresponding change in the angle of the coating blade 2, the position of the spring plate 19 is also changed so that the slot between the end of the spring plate 19 and the coating blade remains substantially constant. In this way, the discharge cross section from the pressure zone R is held approximately constant. As a result, an approximately constant pressure of the coating composition is maintained in the zone R. The flexible strip 9 serves to movably close off the pressure space R. Coating composition that is not applied to the web therefore emerges from the pressure space R via the slot between the end of the spring plate 19 and the coating blade 2 and passes downward through the intermediate spaces between the pressure fingers 18 where it can be collected in a trough (not shown).

The tongue 1 is clamped fast by clamping pieces 28 against a rail 25 on a wall 24 of the feed chamber 8. The rail 25 displaceable by screw drive 29 along the direction transverse to its longitudinal axis. Obliquely arranged guide teeth 27 causes simultaneous displacement of rail 25, parallel and relative to the coating blade 2 upon displacement of the guide rail 26. The pressure rail 7 which is mounted firmly on the feed chamber 8 changes the tension of the spring-like tongue and thus also of the hydrodynamic pressure slot S. The distance a between the end of the tongue 1 and the coating blade 2, for the reasons indicated above, should also be about 2 to 3 cm, or at most about 5 cm. Typically, the distance a is shorter than the length of the slot S, as can be observed in FIGS. 1 and 2.

Excess coating composition emerges in the direction opposite the direction of travel of the web of material, at the rear or upstream edge of the feed chamber 8, from a narrow slot between the rear wall of the feed chamber 8 and the web of material or the counter-roll 3. A collection chamber 30 collects the excess composition. This outflow prevents air from passing into the coating composition in the feed chamber 8.

It is not necessary for the tongue 1 to be resilient in its entirety. It is instead sufficient for it to be resilient in the region of its joint with the application chamber. However, if the tongue 1 is made entirely resilient, it has the advantage that it can adapt itself to sags of the counter-roll, particularly at the outlet edge of the tongue and therefore in the outlet region from the hydrodynamic pressure slot S where the slot is the narrowest. The height of the pressure slot at its outlet end is very small, amounting to only about 0.02 to 0.4 mm, depending on the thickness of the application, the consistency of the coating composition, and the velocity v of the web of material.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A coating device for coating a traveling web of material, comprising:

a counter-roll over which the web of material is guided for movement past the coating device;

a doctor element spaced from the counter-roll and the web thereon for defining the thickness of a coating on the web, the doctor element extending across the web transversely of the direction of web motion;

means defining a coating composition application chamber also extending over the width of the counter-roll and the web, including means for delivering coating composition into the application chamber; the chamber having upstream and downstream sides with respect to the movement of the web; and a resilient tongue extending from the application chamber downstream in the path of travel of the web spaced from and substantially parallel to the web for defining a hydrodynamic pressure slot between the tongue and the web extending across the web and extending to the downstream end of the tongue; the tongue being swingable and being supported against the hydrodynamic pressure in the pressure slot; the downstream end of the tongue being spaced from the doctor element to define a pressure space along the counter-roll and the web and between the downstream end of the tongue and the doctor element wherein coating composition at a pressure higher than ambient pressure is supported to be fed to the doctor element.

2. The coating device of claim 1, wherein the tongue is oriented so that the pressure slot gradually decreases in height over the counter-roll downstream of the path of travel of the web.

3. The coating device of claim 2, wherein the distance between the downstream end of the tongue and of the hydrodynamic pressure slot, on the one hand, and the doctor element, on the other hand, is less than 5 cm.

4. The coating device of claim 2, wherein the height of the dynamic pressure slot at the outlet end thereof is in the range of about 0.02 to 0.4 mm.

5. The coating device of claim 1, further comprising a retention wall supported to the application chamber, spaced from the counter-roll and at least partially covering over the pressure space for retaining coating composition in the pressure space.

6. The coating device of claim 1, wherein the tongue includes a leaf spring therein for providing its resilience.

7. The coating device of claim 1, wherein the tongue is clamped at the upstream end thereof with respect to the path of travel of the web, and the resilience of the tongue is through the clamping being by resilient means permitting the tongue to resiliently deflect under hydrodynamic pressure in the hydrodynamic pressure slot.

8. The coating device of claim 7, wherein the resilient means by which the tongue is clamped comprises a leaf spring at the upstream end thereof.

9. The coating device of claim 8, wherein the leaf spring is attached to the tongue and is attached to the application chamber for supporting the tongue.

10. The coating device of claim 1, wherein the tongue is in its entirety a resilient leaf spring.

11. The coating device of claim 1, wherein the hydrodynamic pressure slot is no longer in the circumferential direction than approximately 5 cm.

12. The coating device of claim 1, wherein the hydrodynamic pressure slot is in the range of 2 to 3 cm in the circumferential direction.

13. The coating device of claim 1, wherein the height of the hydrodynamic pressure slot at the outlet end thereof is in the range of about 0.02 to 0.4 mm.

14. The coating device of claim 1, wherein the application chamber is adjustably mounted with respect to the counter-roll.

15. The coating device of claim 14, wherein the application chamber is swingably mounted with respect to the counter-roll.

16. The coating device of claim 1, wherein at the upstream end of the application chamber, a narrow slot is defined adjacent the counter roll for exit upstream from the application chamber of a small amount of the coating composition.

17. The coating device of claim 1, wherein the hydrodynamic pressure slot is longer in the direction of web motion than the pressure space.

* * * * *